US006616091B2

(12) United States Patent
Priest et al.

(10) Patent No.: US 6,616,091 B2
(45) Date of Patent: Sep. 9, 2003

(54) CABLE WINDING DRUM

(75) Inventors: William L. Priest, Royal Oak, MI (US); Kevin Wright, Detroit, MI (US); Mark D. Nicholas, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/970,166

(22) Filed: Oct. 3, 2001

(65) Prior Publication Data

US 2003/0062441 A1 Apr. 3, 2003

(51) Int. Cl.[7] ..... B65H 75/18

(52) U.S. Cl. ..... 242/602.1; 242/603; 242/613.2; 49/332

(58) Field of Search ..... 242/602.1, 602.2, 242/603, 613.2, 613.3; 254/374; 49/332, 352

(56) References Cited

U.S. PATENT DOCUMENTS

| | | | | | |
|---|---|---|---|---|---|
| 1,403,021 | A | * | 1/1922 | Fogal | 242/602.1 |
| 3,212,727 | A | * | 10/1965 | Fonden et al. | 242/602.1 |
| 4,389,228 | A | * | 6/1983 | Leunig | 242/613.2 |
| 5,025,591 | A | * | 6/1991 | DeLand et al. | 254/374 |
| 5,335,883 | A | * | 8/1994 | Mawer | 242/602.1 |
| 6,282,839 | B1 | * | 9/2001 | Fischer et al. | 49/352 |

* cited by examiner

*Primary Examiner*—John M. Jillions
(74) *Attorney, Agent, or Firm*—Scott A. McBain

(57) ABSTRACT

An automatic sliding door cable mechanism with a take up guide member (46) mounted in a drum (14) for taking up slack of a cable during installation of the cable. A second drum (16) has an elliptical profile drum helix (96) for increasing durability of the operating cable for the automatic door.

8 Claims, 4 Drawing Sheets

CABLE WINDING DRUM

TECHNICAL FIELD

This invention relates to a cable winding drum and more particularly to a cable winding drum for closing a power sliding vehicular door.

BACKGROUND OF THE INVENTION

Power sliding doors for automotive vehicles such as minivans have seen recent popularity. The use of automatic doors is a great convenience for handicapped people, for young children and for other people who have their hands filled for example with groceries.

The use of pull cables have been found to be an expeditious mechanism to both open the door and close the door. When the cable is used to close the door, more torque is need for the cable to close the door against the resisting forces of the seals and door latch. Thus, it is greatly desired to increase the torque exerted by the cable winding drum to overcome the seals and latch mechanism without excessive forces exerted on the cable that may otherwise decrease the durability of the cable.

SUMMARY OF THE INVENTION

In accordance with one embodiment of the invention, a cable winding drum for closing a vehicle power sliding door includes a first helical outer surface with a first radius about an axis of rotation for taking up cable at a first rate when closing the vehicle door. A second outer elliptically contoured helical surface is tangent with the first helical surface in proximity to a major axis of said second outer elliptically contoured helical surface. The take-up drum when in full closed position has the cable extended out on the second outer elliptically contoured helical surface in proximity to its minor axis at a point substantially closer to the axis of rotation than the first helical outer surface.

Preferably, the second outer elliptical contour has an eccentricity of at least 0.5.

It is also desired that the second outer elliptical contour has its minor axis intersect the axis of rotation with the axis of rotation interposed between the elliptical contour and the center point for the elliptical contour.

In accordance with another aspect of the invention, a first outer surface of the drum has a general first radius about the axis of rotation for taking up cable at a first rate. A second outer facing smoothly contoured surface has a greater bent section tangent to the first outer surface with a decreasing radius with respect to the the axis of rotation and a less bent section of the second outer facing smooth surface about the drum, the maximum tension force of the cable is misaligned and at a different point of the cable from the maximum bending force of the cable. It is preferred that the second outer facing smooth contoured surface has an elliptical contour.

In this fashion, the cable have its peak bending forces and peak tensile forces located at different locations along the cable thus lowering the peak combined force load on the cable which increases its durability.

BRIEF DESCRIPTION OF THE DRAWINGS

Reference now is made to the accompanying drawings in which.

DESCRIPTION OF THE PREFERRED EMBODIMENT

Figure 1:
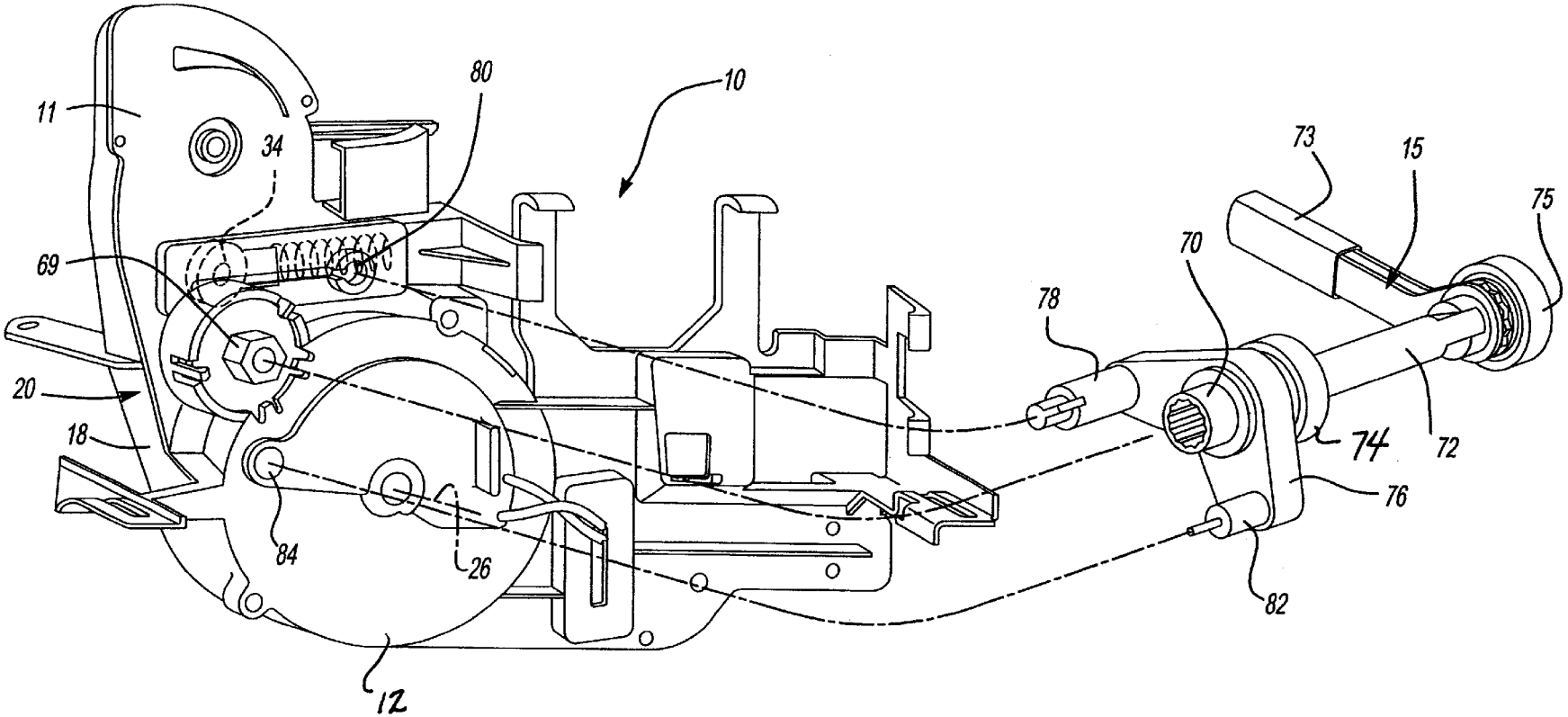
FIG. 1 is a perspective view of a cable drum assembly and a tool for installation.
Figure 2:
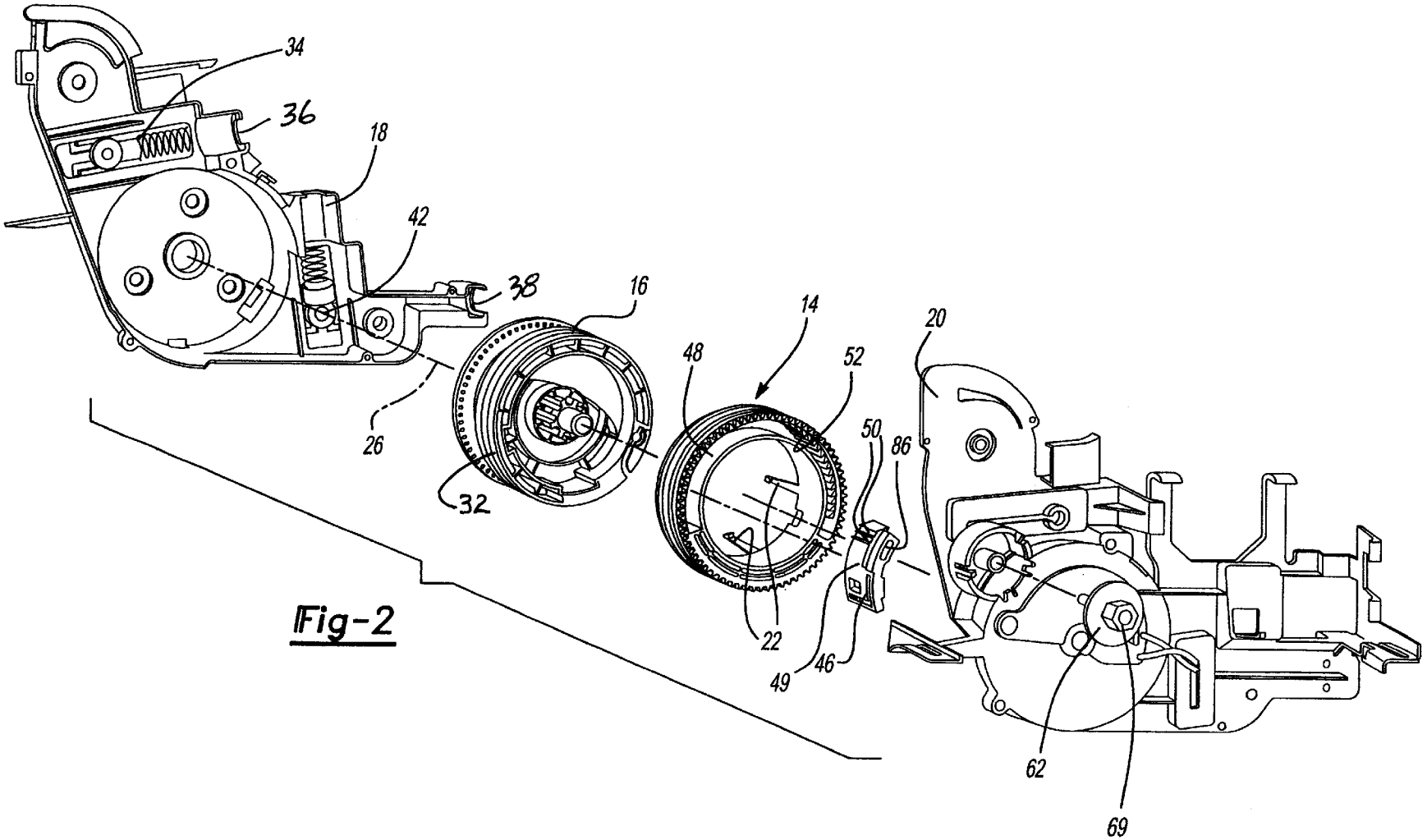
FIG. 2 is an exploded perspective view of the cable drum assembly shown in FIG. 1.

Referring now to FIGS. 1 and 2, a cable tension assembly 10 includes housing 11 that is constructed to have a section 12 that rotatably houses a first drum 14 and second drum 16 that are connected to rotate together. A tool 15 can be operably mounted to the housing as shown in FIG. 1. The housing 11 has a body section 18 and cover 20 that are fitted together to retain the two drums within. The two drums snap fit together via prongs 22 fitting into apertures 24.

Both drums are rotatable via a motor not shown which rotates the drums about axis 26. The motor and controls for the motor are conventional and form no part of this invention.

Figure 5:
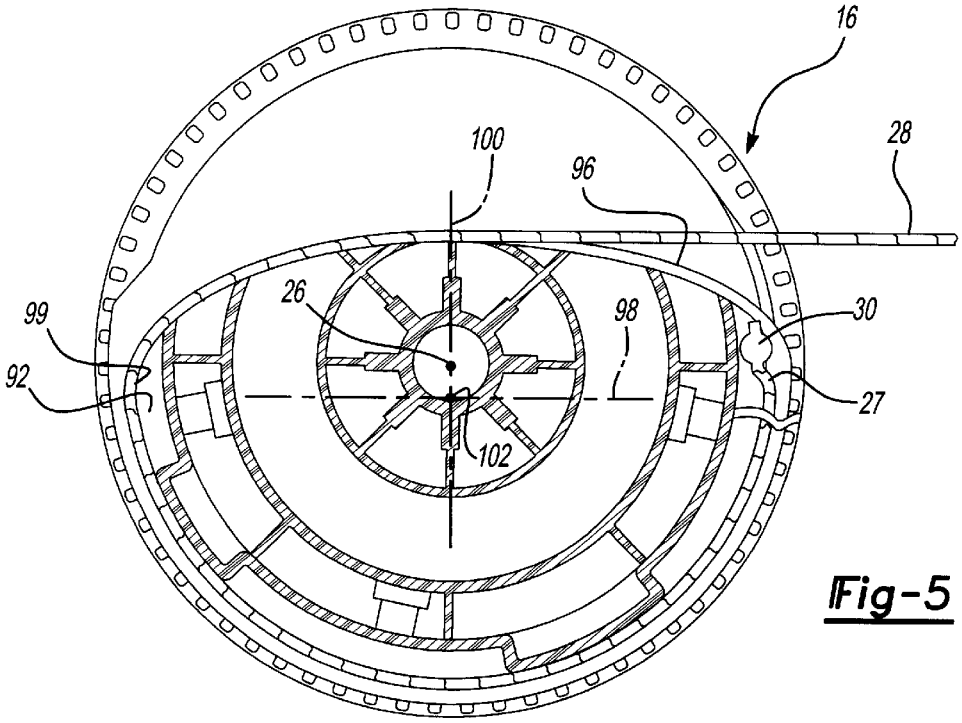
FIG. 5 is a partially segmented plan view of the drum illustrating its elliptical contour section.

A cable 28 has one end secured 27 onto the second drum 16 at point 30 as shown in FIG. 5 and wraps about the outer surface 32 a plurality of times, extends about tension pulley 34 and out through an aperture 36 to exit the housing and be connected to the door (not shown).

Another cable 29 is then attached to the door and has its end 40 return back into the housing through aperture 38 and about a second tension pulley 42 and into the drum 14 through an aperture in the drum that communicates with an arcuate slot 48 within the drum. The end 40 then is connected to a tension take up member 46 that is mounted in the arcuate slot 48 within the drum 14. The take up member 46 has resiliently mounted ratchet teeth 50 on a cantilevered section 49 that normally engage complementary ratchet teeth 52 about the outer wall 54 of the slot 48. The cantilevered section 49 has some resilient flex.

Figure 3:
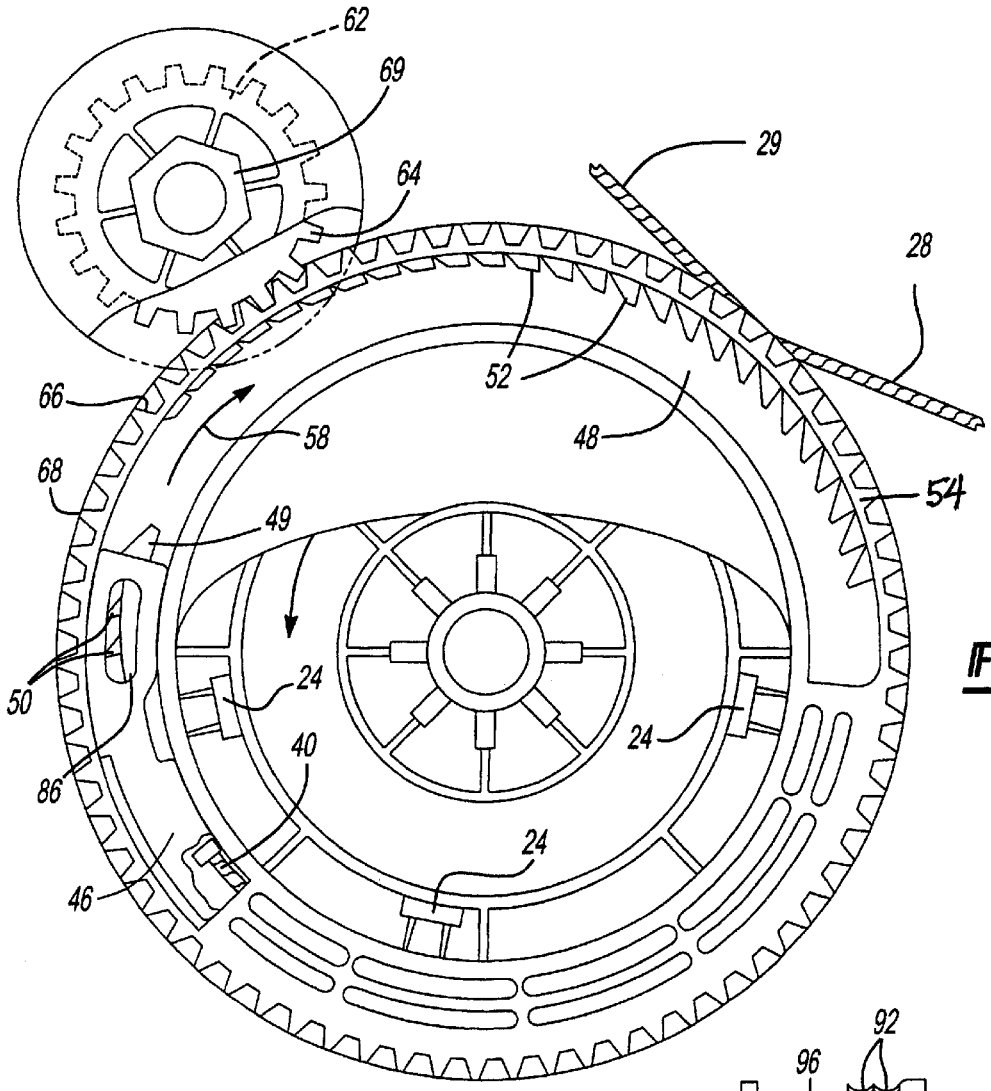
FIG. 3 is front plan view of the drums illustrating the take up guide member in its initial position.

The take up member 46 is initially positioned in proximity to one end 56 of slot 48 as shown in phantom in FIG. 3. Furthermore there is sufficient length of cable 29 such that there is plenty of length of cable to easily reach end 40 of cable 29 into the slot 48 and be securely attached to tension take up member 46 without placing any tension onto cable 28.

Figure 4:
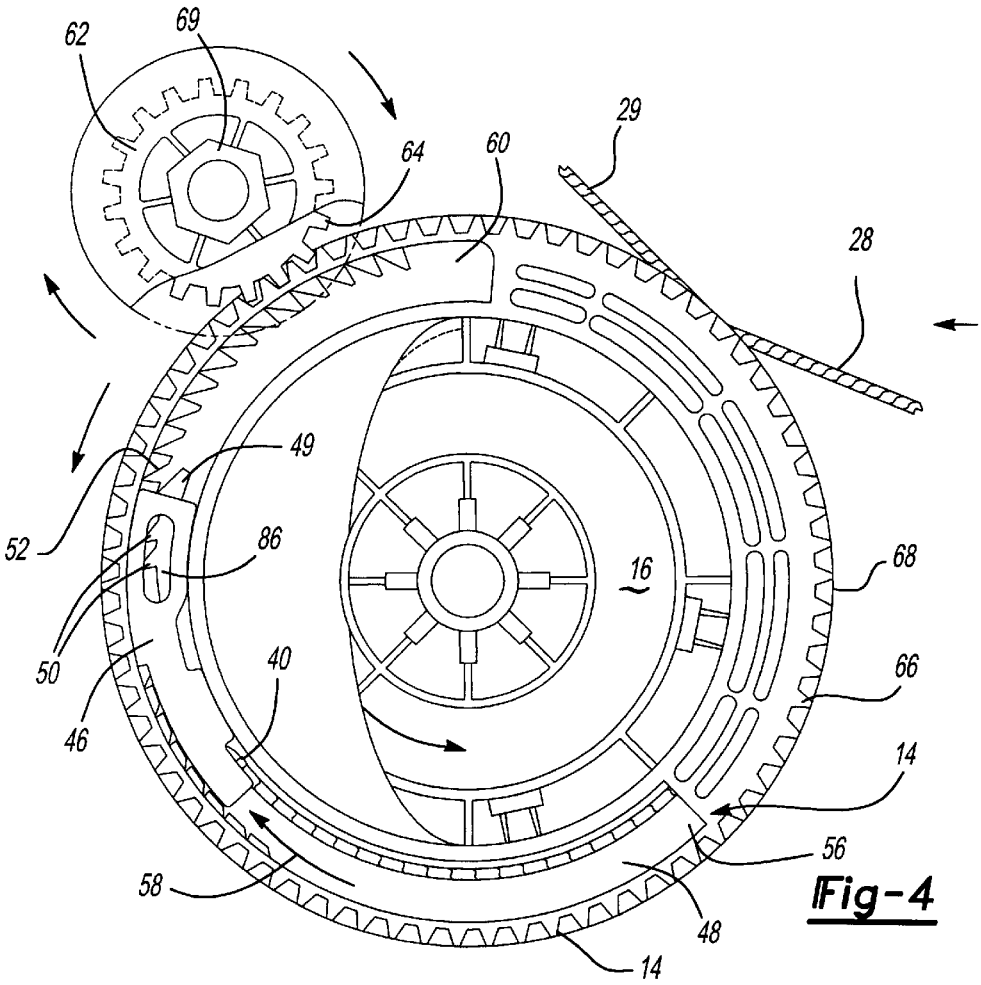
FIG. 4 is a view similar to FIG. 3 after the take up guide member has been moved to take up cable slack.

The take up member 46 is then free to slide in the direction shown by arrow 58 in slot 48 toward the position shown in FIG. 4 with the ratchet teeth 50 on cantilevered section 49 resiliently overriding ratchet teeth 52 in slot 48 until all slack is taken up in cable 29 to a set tension. The teeth 50 and 52 normally prevent the tension take up member from sliding back in a direction opposite arrow 58 toward end 56. It is also noted that the ratchet teeth 52 progressively become larger away from end 56 and toward end 60 to help retain teeth 50 against larger tension forces placed on cable 29.

A tool 15 and a gear wheel 62 expedite the take up of slack and the tensioning of the cable 28. The gear wheel 62 is rotatably mounted adjacent the drum 16 and has gear teeth 64 that engage teeth 66 about the perimeter 68 of drum 16. The gear wheel has an integral hex nut section 69 that can be engaged by tool 15. The tool 15 socket engaging section 70 is mounted on a distal end of a shaft 72 that is moved by a lever handle 73 that is connected through a ratchet connection 74. A knob 75 is also mounted on an opposing end of the shaft. A stop assembly 76 is rotatably mounted about the shaft and has one stop member 78 that protrudes through aperture 80 that limits the compression of the spring loaded pulley 34 to about one-half its travel capacity. Tool 15 also has a second stop member 82 that protrudes through aperture 84 and protrudes into slot 86 of take up guide member 46.

In operation, after the cable 28 has been attached to the door, the door is positioned so that the slot 86 is visible through the aperture 84. The installer then places tool 15 into position and cranks on lever handle 73 to rotate the shaft 72 which in turn rotates the nut 69 and gear wheel 62. The gear then rotates the drum 14 and drum 16. The tool simultaneously retains the take up member such that the take up member slides in slot 48 in the direction indicated by arrow 58 with the teeth 50 and 52 causing clicking indicating sounds. The excess cable is taken up onto the drum 16 as both drums rotate. Pulley 42 has its spring fully compressed and pulley 34 is limited by stop member 78. When the tool is disengaged, the tension on both pulleys 42 and 54 re-balances to provide equal spring resiliency in both pulleys 34 and 42. The take up guide member 46 remains positioned to be accessed through aperture 84 when the door is in the closed position.

If tension in the cable ever needs to be released, the drums 14 and 16 are positioned to align slot 86 with aperture 80. A screw driver is then placed into slot 86 to flex the cantilevered section to disengage the teeth 50 from teeth 52. Once the teeth are disengaged from each other the drums are free to rotate to release the tension of the cable system.

Drum 16 is used to pull cable 28 such that as the cable 28 wraps about its outer surface 90, the door is moved to its closed position. As the door is moved to its fully closed position, the driving motor must overcome the higher torque forces cause by sealing members and the closure latch in the last few centimeters of travel. The extra torque is provided by decreasing the effective outer radius of the drum 16 for the last few centimeters of travel.

Figure 6:
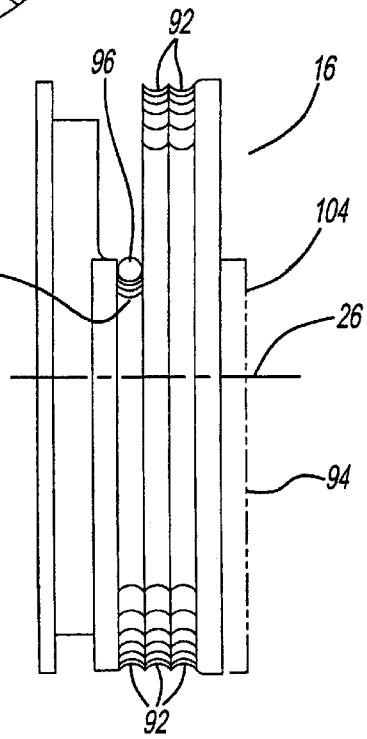
FIG. 6 is a side elevational view of the drum shown in FIG. 5.

The drum 16 as more clearly shown in FIGS. 5 and 6 has a normal circular first outer surface section 92 normally referred to as a drum helix with a first radius indicated at 94. A second outer surface helix section 96 has an elliptical contour that is tangent to the first outer surface section 92 at point 99 in proximity to the major axis 98 of the contour. The minor axis 100 of the elliptical contour intersects the axis of rotation 26. The axis of rotation 26 is interposed between the defined center 102 of the elliptical contour and the elliptical contour surface 96. The elliptical contour is positioned such that the effective radius continually decreases from the tangent point 99 to the minor axis 100 to it's minimum radius indicated at 104.

It can be readily seen that the motor thus can provide for more torque to overcome the resisting forces of seals and latches by placing the cable along a smaller radius 104.

In this fashion, when the door is closed and the most tension is placed on the cable, the highest bending stresses occur near the tangent point 99 near the major axis 98 and the highest tensile forces are in proximity of the minor axis 100. However, the bending stress at the minor axis 100 is lowered due to its flattened elliptical contour. The most bending stress occurs along the major axis 98 where the tensile forces are lower. In this fashion, the location of the highest tensile force and the highest bending stress are displaced from each other along different sections of the cable 28. By displacing the location of these two highest forces from each other, one lowers the peak stress along any given point along the cable and thus provides for a more durable cable.

Variations and modifications are possible without departing from the scope and spirit of the present invention as defined by the appended claims.

We claim:

1. A cable winding drum for closing a vehicle power sliding door, said drum comprising:

a first helical outer surface with a first radius about an axis of rotation for taking up cable at a first rate when closing said vehicle door;

a second outer elliptically contoured helical surface being tangent with said first helical surface in proximity to a major axis of said second outer elliptically contoured helical surface;

the take-up drum when in full closed position having a cable extended out on the second outer elliptically contoured helical surface to its minor axis at a point substantially closer to the axis of rotation then said first helical outer surface.

2. A cable winding drum as defined in claim 1 further comprising:

said second outer elliptical contour having an eccentricity of at least 0.5.

3. A cable winding drum as defined in claim 2 further comprising:

said second outer elliptical contour having its minor axis intersect the axis of rotation with the axis of rotation interposed between the elliptical contour and a center point for the elliptical contour.

4. A cable winding drum as defined in claim 1 further comprising:

said second outer elliptical contour having its minor axis intersect the axis of rotation with the axis of rotation interposed between the elliptical contour and a center point for the elliptical contour.

5. A drum for winding up a cable in tension by rotation about a central axis of rotation, said drum comprising:

a first outer surface with a general first radius about the axis of rotation for taking up cable at a first rate;

a second outer facing smoothly contoured surface having a greater bent section tangent to said first outer surface with a decreasing radius to said axis of rotation and a less bent section of said second outer facing smoothly contoured surface about said drum, the maximum tension force of said cable being misaligned and at a different point of the cable from the maximum bending force of the cable, the second outer facing smoothly contoured surface having an elliptical contour.

6. A cable winding drum as defined in claim 5 further comprising:

the elliptical contour having an eccentricity of at least 0.5.

7. A cable winding drum as defined in claim 5 further comprising:

the elliptical contour having its minor axis intersect the central axis of rotation with the central axis of rotation interposed between the elliptical contour and a center point for the elliptical contour.

8. A cable winding drum as defined in claim 7 further comprising:

the elliptical contour having its minor axis intersect the central axis of rotation with the central axis of rotation interposed between the elliptical contour and a center point for the elliptical contour.

* * * * *